US006351923B1

(12) United States Patent
Peterson

(10) Patent No.: US 6,351,923 B1
(45) Date of Patent: Mar. 5, 2002

(54) SPACER FOR INSULATED WINDOWS HAVING A LENGTHENED THERMAL PATH

(76) Inventor: Wallace H. Peterson, 5312 23rd Ave. W., Everett, WA (US) 98203

( * ) Notice: Subject to any disclaimer, the term of this patent is extended or adjusted under 35 U.S.C. 154(b) by 0 days.

(21) Appl. No.: 09/359,341

(22) Filed: Jul. 21, 1999

Related U.S. Application Data

(63) Continuation-in-part of application No. 09/222,065, filed on Dec. 29, 1998, now Pat. No. 6,131,364, which is a continuation-in-part of application No. 08/898,705, filed on Jul. 22, 1997, now abandoned.

(51) Int. Cl.[7] ..... E06B 3/663
(52) U.S. Cl. ..... 52/786.13; 52/745.16
(58) Field of Search ..... 52/171.3, 786.13, 52/786.1, 745.16; 428/34

(56) References Cited

U.S. PATENT DOCUMENTS

| | | | | |
|---|---|---|---|---|
| 4,057,945 A | | 11/1977 | Kessler | |
| 4,850,175 A | * | 7/1989 | Berdan | 52/786.13 |
| 5,377,473 A | | 1/1995 | Narayan et al. | |
| 5,439,716 A | | 8/1995 | Larsen | |
| 5,568,714 A | * | 10/1996 | Peterson | 52/786.13 |
| 5,630,306 A | * | 5/1997 | Wylie | 52/786.13 |
| 5,679,419 A | * | 10/1997 | Larsen | 52/786.1 X |

FOREIGN PATENT DOCUMENTS

| | | |
|---|---|---|
| EP | 0350381 A1 | 1/1990 |
| FR | 2412238 | 7/1979 |
| GB | 0751807 | 7/1956 |
| GB | 0846570 | 8/1960 |
| GB | 0948032 | 1/1964 |
| IT | 628314 | 11/1961 |

* cited by examiner

*Primary Examiner*—Laura A. Callo
(74) *Attorney, Agent, or Firm*—Todd N. Hathaway

(57) ABSTRACT

A spacer frame bar for insulated windows or other insulated glass panels. The bar includes a tubular spacer member having first and second side webs for engaging the spaced apart glass panes, and upper and lower webs spanning between the side webs. The upper web is provided with a series of vertical corrugations, which serve to increase the length of the thermal conductive path across the upper web. The corrugations are also arranged so that only the upper edges thereof are exposed to sunlight passing through the window, thereby minimizing thermal gain due to absorption of solar radiation. Staggered rows of slits may be formed in the channels of the corrugations to as to further increase the length of the conductive path. The channels may also be filled with an insulating material, such as a resilient foam material. The invention also provides a two-piece construction in which the top web clips onto the upper edges of the side webs.

32 Claims, 7 Drawing Sheets

SPACER FOR INSULATED WINDOWS HAVING A LENGTHENED THERMAL PATH

This is a continuation-in-part application of pending patent application Ser. No. 09/222,065, entitled "Spacer for Insulated Windows having a Lengthened Thermal Path", which was filed Dec. 29, 1998, now U.S. Pat. No. 6,131,364, which is a continuation-in-part application of patent application Ser. No. 08/898,705, entitled "Spacer for Insulated Windows having a Lengthened Thermal Path", which was filed Jul. 22, 1997, now abandoned.

BACKGROUND OF THE INVENTION a. Field of the Invention

The present invention relates to spacer frame bars which are used to maintain separation between glass panes in insulated glass windows and other panels and, in particular, to a spacer frame bar having an upper web which is configured to create a lengthened thermal path between the glass panes without causing a significant increase in thermal gain when exposed to solar radiation.

b. Related Art

It is well known in the art to provide a window with more than one pane of glass separated by an airspace. Such windows are known as insulating windows or insulated glass panels, by virtue of the fact that the air and/or other gasses (argon, helium, nitrogen, etc.) trapped within the space between the glass panes serves as an insulator to reduce heat flow through the window.

Typically, the glass panes are separated by a spacer frame which lies between the glass panes and extends around their perimeter. The spacer frame is typically constructed of sections of tubular material, also known as spacer frame bars, which are usually made of a metal such as aluminum alloy, steel or stainless steel. In addition to being commercially economical, these materials have the strength and rigidity which are required in order for the spacer frame serve its structural functions. Also, aluminum and steel exhibit good corrosion resistance and are stable over a wide range of temperatures, and the structural integrity of these materials is not adversely affected by long-term exposure to sunlight.

The use of aluminum, steel or other metals in a spacer frame, however, is not without its problems. A significant heat transfer problem may arise because an aluminum or metal spacer is a much better heat conductor than the surrounding airspace. Because the spacer and glass panes are contiguous, the spacer itself acts as a conduit for energy transfer between inside and outside panes of glass. Thus, significant energy loss may result because of the spacer's physical contact with the glass panes.

Moreover, heat transfer through the spacer may cause the edge or other area of the window which is in contact with the spacer to be at a significantly higher or lower temperature than the rest of the pane. In particular, where outside temperatures are cold, this may cause the edges of the window to be relatively cool around the interior pane (i.e., cooler than the interior of the building), resulting in serious condensation problems.

One partial solution to heat transfer through the spacer is provided by U.S. Pat. No. 5,568,714 to Peterson. The invention of Peterson provides an elongate tubular spacer with an integral thermal break that reduces energy flow between glass panes. Although the thermal break impedes heat transfer through the spacer, heat transfer impedance can still be an issue because the metal on either side of the thermal break still rapidly conducts thermal energy.

Another partial solution is provided by U.S. Pat. No. 5,377,473 to Narayan et al. The invention of Narayan provides a spacer having a lower web which is generally W-shaped in cross-section, and an upper web which is pierced by a series of slots which are intended to eliminate straight-line thermal paths across the web and also to allow fluid contact between the air in the interpane space and a desiccant material inside the spacer. Unfortunately, the slots also allow the desiccant material (typically, a silica gel or other material which is in granular form so as to maximize surface area) to escape from the spacer and into the interpane space, where it tends to foul the inside surfaces of the panes.

Although some prior attempts have thus been made to reduce heat transfer through a spacer by forming a lengthened thermal path in one way or another, the results have been somewhat mixed. In particular, the upper web of the spacer (i.e., that part of the spacer which faces inwardly towards the interpane space) has remained something of a "weak link," in that this often forms the shortest, most direct thermal path between the two panes. Typically, the upper web has been confined to a generally horizontal plane, extending perpendicular to the planes of the glass, both for aesthetic reasons and also because the upper web of the spacer must not project above the "sight line" of the window or else it will obstruct and reduce the available viewing area.

An additional complication relates to the fact that the upper web of the spacer is typically exposed to fairly intense solar radiation, i.e., sunlight. Absorption of solar radiation causes thermal gain (i.e., heating) in the spacer unit, with the thermal energy being transferred to the adjoining panes. This can be a serious source of thermal inefficiency, particularly in hot, sunny climates. For example, in such climates the interiors of buildings are commonly air-conditioned, and in a large building (such as a commercial office tower) the combined thermal gain of the spacers in the numerous windows can contribute significantly to the load on the air-conditioning plant. Therefore, it is generally desirable to reduce the tendency of the spacer to absorb solar radiation, and, conversely, any configurations which are intended to increase the length of the thermal path across the upper web should not do so at the cost of added absorption of such radiation.

Accordingly, there exists a need for an improved metal spacer bar which defines elongate thermal conductive paths between glass panes, particularly across the top web of the spacer, so as to enhance the thermal efficiency of insulated windows or other panels. Furthermore, there exists a need for such an improved spacer bar which provides such lengthened conductive paths without causing increased thermal gain of the spacer due to absorption of solar radiation. Still further, there exists a there exists a need for such a spacer bar which establishes fluid contact between the air or other gasses in the interpane space and a desiccant material within the bar, but without possibility of the desiccant escaping therefrom into the space between the panes.

SUMMARY OF THE INVENTION

The present invention has solved the problems which have been cited above. Broadly, this is a spacer frame bar comprising an elongate tubular spacer member having first and second side webs for engaging first and second glass panes in spaced relationship, and upper and lower webs spanning from the first side web to the second side web and defining a spacer width between the side webs, the upper web of the spacer member comprising at least first and second corrugations formed in the upper web, each corrugation defining an upwardly extending ridge portion and a downwardly extending channel portion so that the corrugations form an elongate thermal energy conductive path across the upper web which is greater in length than the spacer width between the side webs, the corrugations further being oriented so that only an upper edge of each ridge portion is exposed to solar radiation between the glass panes and the channel portions of the corrugations are substantially shaded by adjacent corrugations, so that the upper web of the spacer member forms the elongate conductive path without causing increased thermal gain of the spacer member when the window assembly is exposed to solar radiation.

In a preferred embodiment, the corrugations may comprise a plurality of parallel, longitudinally extending corrugations arranged across the width of the upper web, and the ridge and channel portions of the corrugations may be oriented in a substantially vertical direction.

The upper web of the spacer member may further comprise at least one spaced sequence of longitudinally oriented slits formed through the web in each of the corrugations, so that the slits form a series of thermal breaks across the web. The spaced sequence of slits in each corrugation may be staggered longitudinally relative to the slits in adjacent corrugations.

The spaced sequences of slits may be formed in side walls of the corrugations intermediate the upper ends of the ridge portions and the lower ends of the channel portions. Each corrugation may comprise at least two spaced sequences of slits on opposite sides of the corrugation. The slits may each comprise a first longitudinal edge portion which is displaced relative to a second edge portion by an amount which is sufficient to open an air gap between the edges of the slit.

The spacer member may further comprise at least one insulating member which is mounted in the corrugations of the upper web. The insulating member may comprise a plurality of strips formed of insulating material, each insulating strip being mounted in the channel portion of one of the corrugations. The insulating strips may substantially fill the channel portions so that only an upper crown of each ridge portion is exposed above the insulating material. The insulating material may comprise a resilient foam material.

Each of the channel portions may comprise means for engaging and retaining the strip of insulating material therein. The means for retaining the strip may comprise an inwardly-bent tab portion of a slit formed in the wall of the channel portion, or may comprise at least one inwardly-protruding point formed in the wall of the channel portion.

The spacer member may be formed of inner and outer halves, the halves being joined along upper and lower longitudinally extending seams. The spacer member may also be formed as a two-piece structure in which there is a lower, generally "U" shaped channel member which incorporates the lower and side webs of the spacer member, and an upper cap member which incorporates the upper web of the spacer member, the outer edges of the cap member cooperating with the upper edges of the channel member to form connection joints by which the cap member is mounted to the channel member.

The connection joints may each comprise a generally "V" shaped receiving channel formed along an upper edge of the channel member, and a flange portion formed along an outer edge of the cap member which extends downwardly therefrom into locking engagement with the channel. The receiving channel may comprise a lip portion which extends downwardly from an edge of the receiving channel to a position above a lower edge of the flange portion, so as to retain the flange portion against being withdrawn upwardly out of the receiving channel. The flange portion, in turn, may comprise a lip portion which extends upwardly from the lower edge thereof so as to engage the lip portion of the receiving channel in substantially vertical abutment therewith.

BRIEF DESCRIPTION OF THE DRAWINGS

The foregoing aspects and many of the attendant advantages of the invention will become better understood by reference to the following detailed description, when taken in conjunction with the accompanying drawings, wherein.

DETAILED DESCRIPTION a. Spacer Structure

Figure 1:
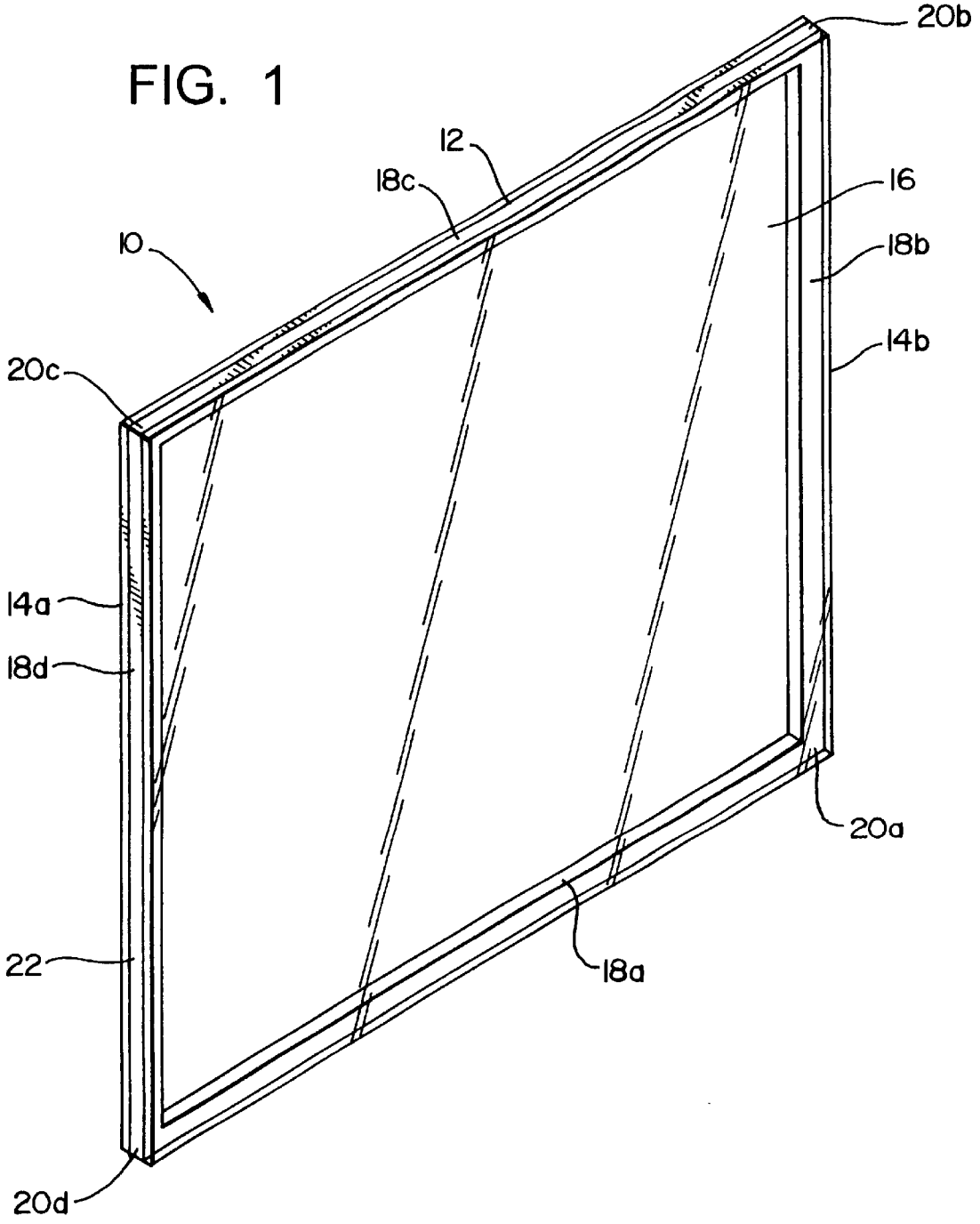
FIG. 1 is a perspective view of one embodiment of an insulated glass window constructed in accordance with the present invention.

An insulated glass panel 10 in accordance with the present invention is illustrated in FIG. 1. As can be seen, panel 10 includes an essentially rectangular spacer frame 12 sandwiched between first and second panes of glass 14*a*, 14*b*, thereby defining a hermetic airspace 16 within the space bounded by the panes and frame. The frame 12 extends completely around the outer periphery of the insulated glass panel 10, adjacent the peripheral edges of the glass panes 14. The frame is formed by segments of spacer frame bars 18*a*, 18*b*, 18*d*, referred to herein from time to time as simply "spacers", joined at their ends by connectors to define corners 20*a*, 20*b*, 20*c*, 20*d*.

For ease of understanding, the terms "upward", "upper", "top" and so on will refer in this description and the appended claims to that side of the spacer which faces towards the interpane space (i.e., towards the space between the two panes; conversely, the terms "downward", "lower", "bottom" and the like will refer to the side of the spacer which faces in the opposite direction (i.e., outwardly from the interpane space), and the terms "side", "lateral", and the like will refer to the sides of the spacer which face towards the panes. It will be understood, of course, that the actual physical orientation of the spacer will depend on its location within the window or other panel. Furthermore, the term "window", as used in this description and the appended claims, means all panels constructed of glass or similar panes, whether used for viewing, admission of light, or other purposes.

Figure 2:
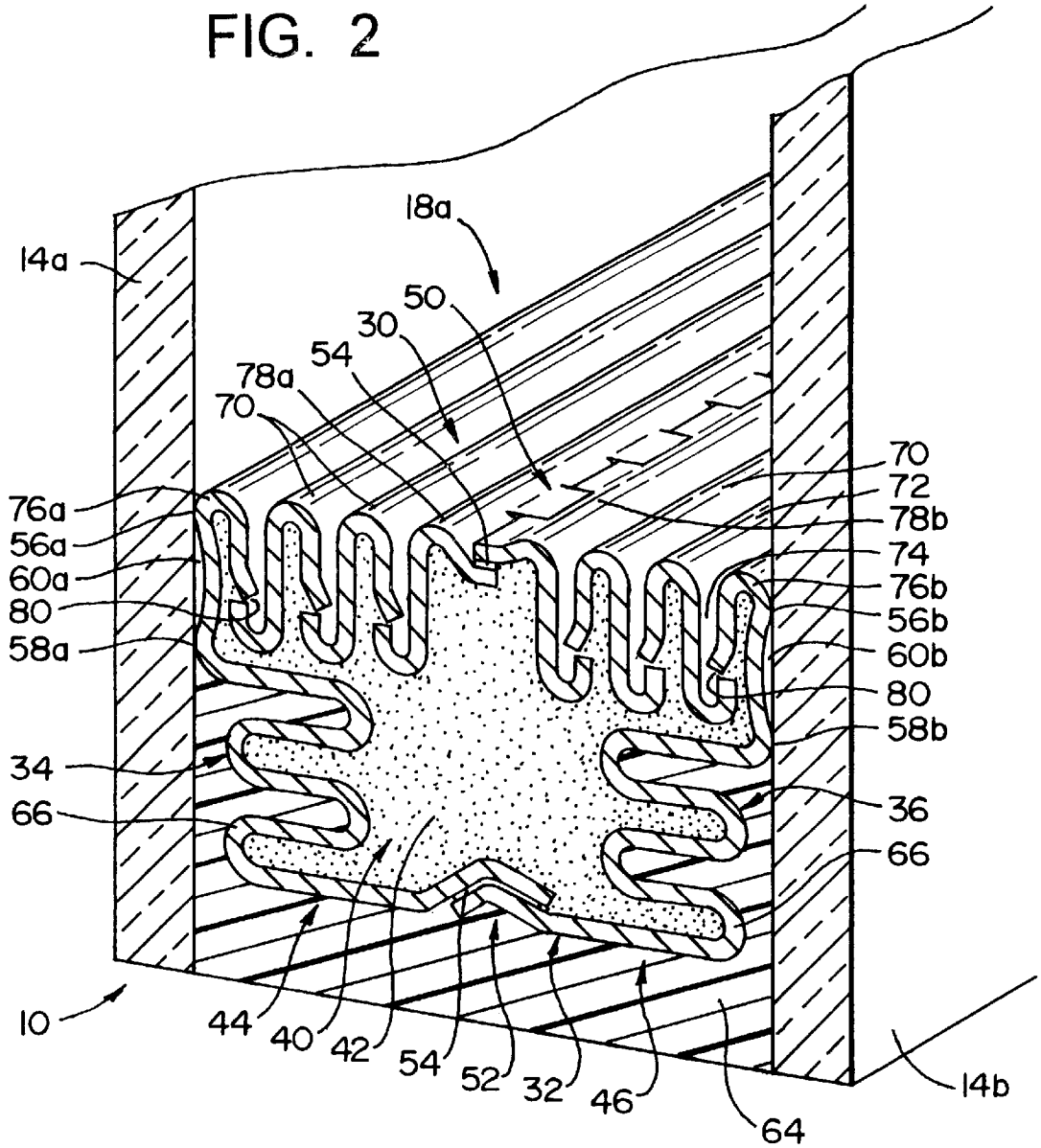
FIG. 2 is a cross-sectional, perspective view of an insulated glass panel showing a first embodiment of spacer frame bar in accordance with the present invention positioned between two glass panes, showing the corrugated and slitted upper web thereof.

FIG. 2 shows an exemplary one of the spacer bars of which frame 12 is constructed. As can be seen, the spacer bar 18*a* is generally rectangular in cross-section, having generally parallel upper and lower webs 30, 32, and generally parallel side webs 34, 36. The four webs define a hollow interior 40, which typically contains a mass of desiccant material 42, such as silica gel, usually in particulate form.

In the embodiment which is illustrated in FIG. 2, the spacer bar is formed by joining first and second halves 44, 46, each of which has a generally "C" shaped cross-sectional profile. The first and second halves are preferably each roll formed from a continuous piece of high strength material, such as aluminum alloy or steel, although other materials, such as glass or composite materials, are within the scope of the invention. Similarly, although the spacer bar which is shown in FIG. 2 is constructed from inner and outer halves, other forms of construction, such as the two-piece "clip-together" construction described below or unibody construction, are also within the scope of the present invention.

The two halves 44, 46 may be joined in any suitable manner. In the embodiment which is illustrated, the longitudinal edges of the halves are periodically and transversely slit to define a series of short, transverse tabs which are alternately crimped. The crimped tabs are interleaved in alternating fashion to form the connection between the edges of the halves: As is shown, a first elongate seam 50 is thus formed along the upper web 30 of the spacer by the overlapping intersection of the first and second halves, and a second seam 52 is similarly formed along the lower web 32. The seams each preferably include an insulating strip 54, which is installed between the interleaved tabs to form an integral thermal break between the two halves. The insulating strip 54 is suitably formed of a non-metallic, low heat-conductive material, such as plastic or rubber, for example, and is preferably interwoven into the seams in the manner disclosed in U.S. Pat. No. 5,568,714 to Peterson, the disclosure of which is hereby incorporated by reference herein.

The first and second side webs of the spacer bar preferably contact the glass panes 14*a*, 14*b*, along integrally molded upper and lower contact ridges 56*a*, 56*b* and 58*a*, 58*b*, such that the contact area between the spacer bar and the glass panes is essentially limited to two sets of lines. The upper contact lines are formed substantially near the corners between the top and side webs of the bar, while the lower contact lines are formed a spaced distance below the upper contact lines, preferably substantially near the midpoints of the side webs 34, 36. The upper and lower contact lines protrude beyond the general plane of their respective side webs, with curved recesses 60*a*, 60*b* being formed between each pair of lines. While thus limiting contact between the bar and panes to two sets of contact lines is generally preferred, it will be understood that other configurations, such as flat side walls which contact the glass panes, are also in the scope of the present invention.

As is shown in FIG. 2, a sealant 64, preferably an elastomer or mastic-like material, extends about the outer periphery of the insulated glass panel 10 and is formed into the recesses of the first and second halves of the spacer, as well as into other spaces between the side webs 34, 36, and the panes 14*a*, 14*b*. The sealant 63 thus assures that the panes are hermetically bonded to the frame 12.

In the embodiment of the invention which is illustrated in FIG. 2, the lower halves of the side webs 34 and 36 are provided with horizontal folds 66. The folds are formed below the lower contact lines 58*a*, 58*b*, such that these define parallel and alternating indentations and protrusions which extend substantially normal to the plane of the glass. The folds lengthen the thermal migration path through the bottom and sides of the spacer, by providing additional material through which heat must travel before reaching the opposing pane. The folds in the side webs do not contact the panes, and therefore define voids which are filled with the sealant material. While providing folds in the side webs is thus generally preferred, it will be understood that side webs which are devoid folds are also within the scope of the invention.

So as to further increase the length of the conductive path across the bottom of the spacer bar, the lower seam 52 can also be bent upwardly as shown in FIG. 2, so that the interleaved tabs assume something of an inverted "V" configuration. Additionally, this configuration reinforces the engagement of the tabs, so as to form a very strong seam which resists separation of the two halves of the assembly.

b. Upper Web

With further reference to FIG. 2, it will be seen that the upper web 30 of the spacer bar, rather than being flat as in conventional forms of construction, is provided with a plurality of longitudinal, substantially parallel corrugations 70. These follow a somewhat sinusoidal path about the generally horizontal plane of the upper web, each corrugation defining a ridge portion 72 and a channel portion 74.

In the embodiment which is illustrated in FIG. 2, in which the first and second halves of the spacer are joined by longitudinal center seams, the corrugations are arranged into first and second parallel sets on either side of the top seam. The outermost ridges 76*a*, 76*b* in each set may conveniently be formed as continuations of the bends which form the upper contact lines 56*a*, 56*b*, with the a material being bent back on itself so as to extend inwardly and downwardly towards the adjacent channel; the innermost ridges 78*a*, 78*b*, in turn, flank the center seam 50 and flatten out along their inner edges to form the interlocking tabs. In other embodiments, of course, the seam may have a different form or the corrugations may be continuous across the entire upper web of the spacer.

Figure 3:
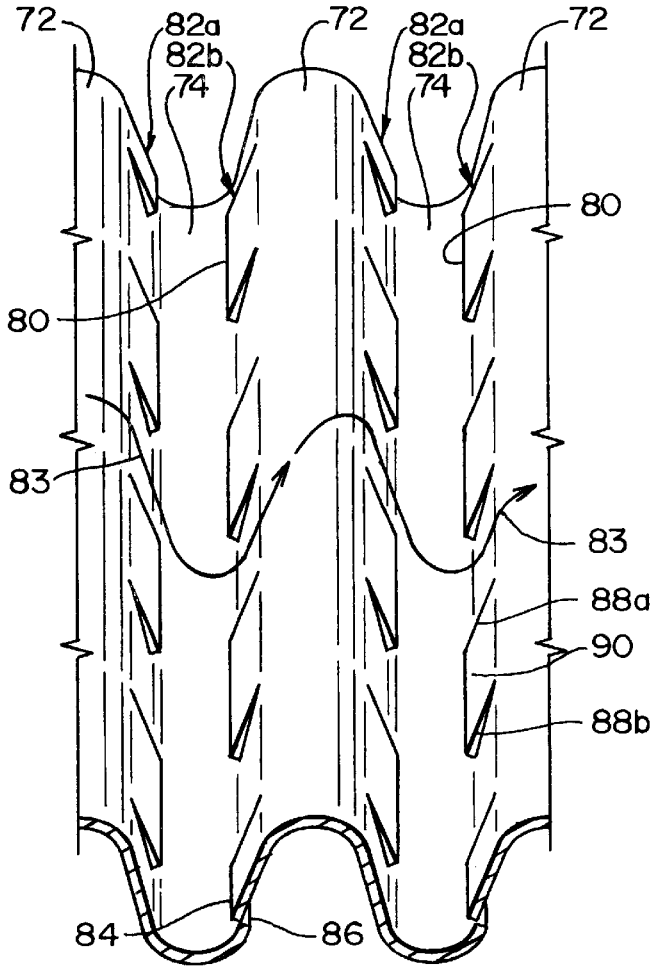
FIG. 3 is a plan, somewhat schematic view of a portion of the corrugated and slitted upper web of the spacer bar of FIG. 2, showing the arrangement of longitudinal slits which are formed therein for further increasing the length of conductive paths across the upper web of the bar.

Furthermore, each of the corrugations 70 preferably includes a series of longitudinally-oriented, spaced apart slits 80. As can be seen in FIG. 3, there are preferably at least two rows 82*a*, 82*b* of slits in each corrugation, on opposite sides of each channel. A particular advantage of the corrugated upper web is that (in those embodiments which include the slits) the corrugations increase the number of slits which can be formed in the space between the two glass panes; for example, a section of flat, planar web might be able to accommodate only one row of slits in the same space where the corrugated web is able to accommodate two rows.

As can be seen with reference to FIGS. 2–3, each of the slits 80 forms a thermal break, i.e., the longitudinal edges of the slit are separated by an airgap which prevents direct communication of thermal energy across the slit. Moreover, the slits are preferable arranged so as to be staggered from one row to the next, such that the slits in one row alternate and overlap in spaced relationship the slits in the next row, thereby eliminating any straight-line conductive path in the transverse direction.

The slits 80 therefore cooperate with corrugations 70 to greatly increase the length of the conductive path across the upper web of the spacer. As can be seen in FIG. 3, the corrugations force the energy to follow a path which travels up and down in the vertical plane, while at the same time the staggered slits force the energy to travel back and forth in the horizontal plane. As a result, thermal energy passing from one glass pane to another follows a tortured, circuitous path as indicated by arrows 93, through a distance which is much longer than the straight-line distance from one glass pane to the other.

In addition to providing thermal breaks, the slits also serve as ventilation apertures which establish fluid communication between the interpane airspace 16 and the interior of the spacer. This allows the desiccant material 42 (e.g., silica gel) in the spacer to dehumidify the air/gas which is trapped in the airspace during assembly of the window, thereby minimizing the possibility of condensation forming inside the window. As is well known in the art, air is constantly circulated within the window by changes in barometric pressure, which cause the glass panes to act like diaphragms which pump air in and out of the airspace 16.

In order to permit the air pass in and out of the spacer, but at the same time prevent the desiccant material from escaping, slits 80 are preferably formed not by punching or piercing clear through the upper web of the spacer, but instead by shearing or splitting the material along the edges 84, 86 of the slits and moving this apart so as to create an air gap which is wide enough to interrupt conduction of thermal energy, but not so large as to allow granules of desiccant to pass therethrough. The slits can be formed in this manner using a rotating cutter reel, which allows the slits to be formed continuously during roll forming of the spacer, rather than having to stop or otherwise hold the material stationary for punching or stamping.

When the slits are formed in this manner, the metal also breaks or "tears" back at the ends of the slits, forming first and second transverse edges 88*a*, 88*b* (see FIG. 3). The result is essentially a shallowly bent tab portion 90, bordered by thermal breaks along three sides. The "tear back" edges 88*a*, 88*b* along the sides of the tabs extend laterally towards the next row of slits, which further increases the length of the conductivity path by not allowing the heat to travel in a direct, diagonal line from the end of one slit to the next.

Figure 4:
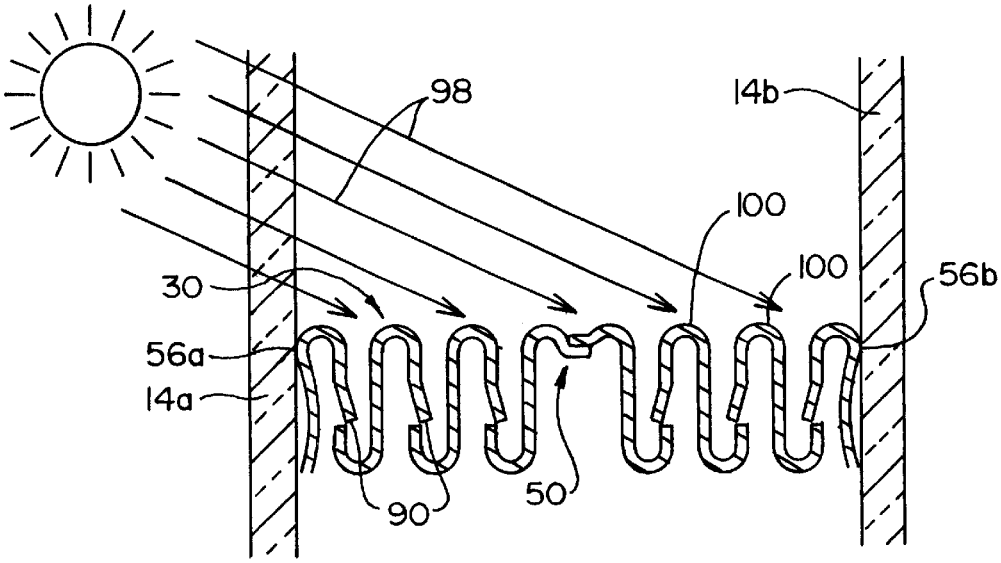
FIG. 4 is cross-sectional, somewhat schematic view of the window and spacer bar of FIGS. 1–3, showing the manner in which the configuration of the top web minimizes thermal gain of the bar when exposed to solar radiation.

While, as has been described above, the corrugated configuration of the upper web provides a greatly lengthened thermal path, it does this without the expense of added thermal gain when exposed to solar radiation. As is seen in FIG. 4, solar radiation passing through the outer glass pane 14*a*, as indicated by arrows 98, strikes only the tops or "crowns" 100 of the ridge portions, the major portion of each corrugation being shadowed by its neighbors. In other words, only the crowns 100 are exposed to the radiation, and these represent only a very small fraction of the total surface area of the web 30. Moreover, because the surfaces of the crowns 100 are curved (owing to the curvature of the bends in the metal), these will have a tendency to deflect and scatter solar radiation rather than absorb it, even when the sun is at its highest elevation relative to the spacer.

The advantages provided by the corrugations in the upper web pertain regardless of whether the web also includes the slits 80. It will therefore be understood that, while a preferred form and arrangement of slitted web has been described above, spacers having webs with other forms of slits or no slits at all are also within the scope of the present invention. It will also be understood that while the vertically aligned, evenly spaced corrugations which are shown in the figures have numerous advantages, including manufacturing economy, ease of installation and aesthetics, for example, in other embodiments the corrugations may be angled in one direction or another, may have varied spacings or heights, and so on. Moreover, in some embodiments the corrugations may be formed by means other than by the roll-forming or bending of sheet metal, as by casting, cutting or machining, for example.

c. Insulating Strips

Figure 5:
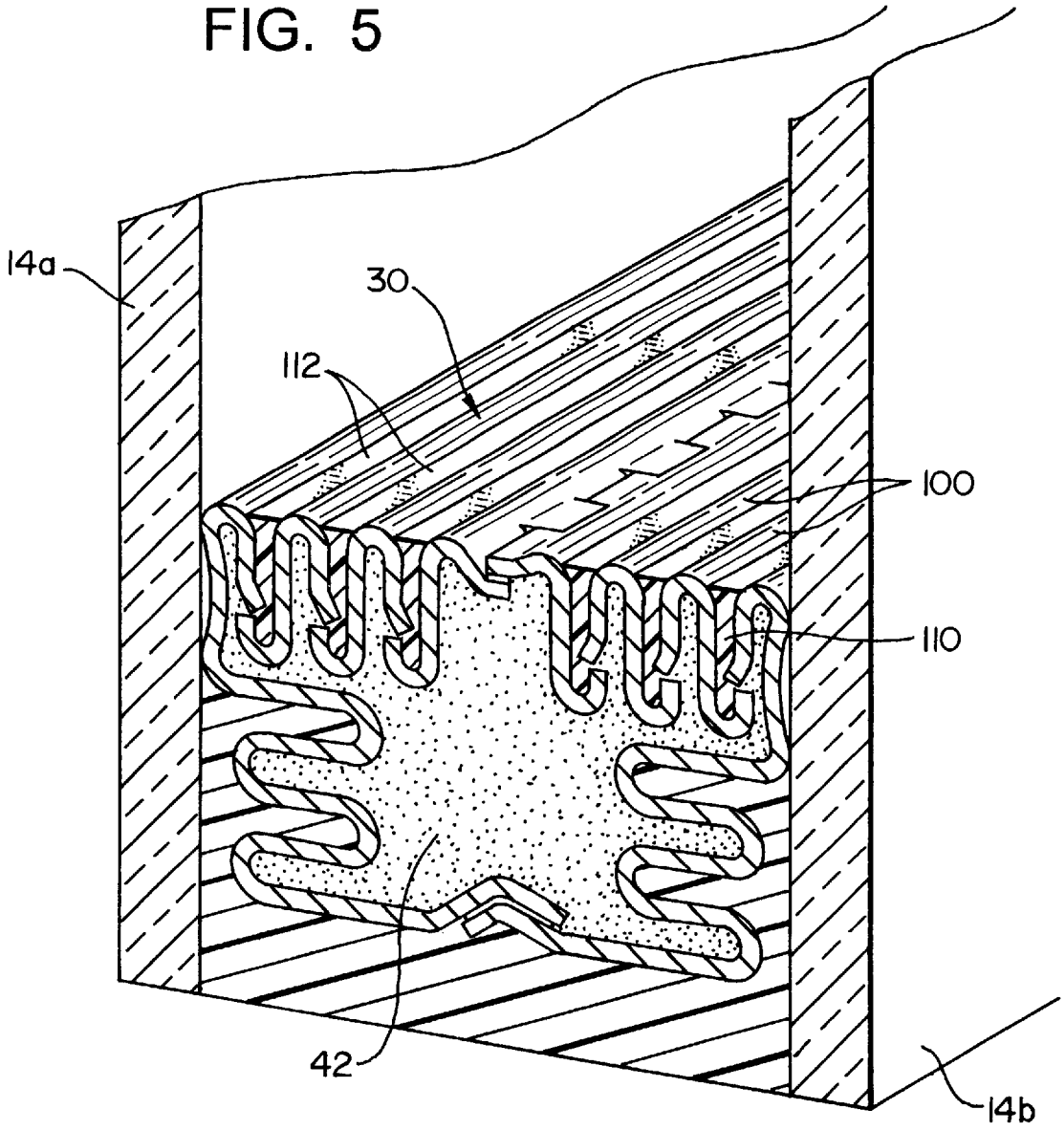
FIG. 5 is a cross-sectional, perspective view similar to FIG. 2, showing an embodiment of spacer frame bar in which the corrugations are filled with an insulating material which further reduces thermal transmission between the inner and outer panes of the window assembly.

As is shown in FIG. 5, the channel portions 74 of the corrugations can be filled with an insulating material 110, so as to further reduce thermal gain and heat migration across the upper web of the spacer. In the embodiment which is illustrated in FIG. 5, the insulating material is formed into a plurality of individual strips 112 which are installed in the channels by suitable means, such as by pressing or by extruding the material directly into the channels, for example.

Figure 6:
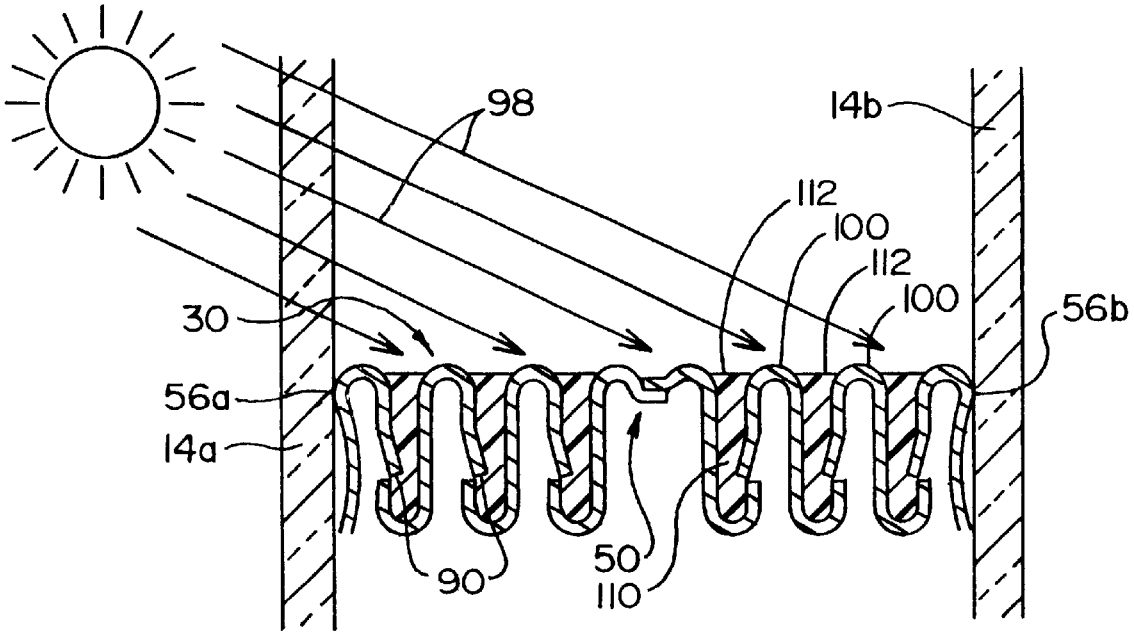
FIG. 6 is a cross-sectional, somewhat schematic view similar to FIG. 4, showing the manner in which the insulating inserts in the channels of the corrugations serve to further reduce thermal gain of the bar when exposed to solar radiation.

Since, as can be seen in FIG. 6, the strips of insulating material leave only the very tops of the crowns 100 exposed, the potential for thermal gain from absorption of solar radiation is greatly minimized. Moreover, to further reduce thermal gain, the crowns (or the entire top of the upper web) can be painted white, since this color generally has the lowest thermal absorption rate, and the insulating material itself can also be painted or formed in a white color if desired.

The geometry of the channels is preferably configured so as to grip the insulating material and retain it therein, since the different thermal expansion rates of the insulating material and metal web will otherwise tend to cause the former to buckle or "pop" out of the channels. For example, in the embodiment which is shown in FIG. 5 the tab portions 90 of the slits 80 are bent inwardly and upwardly, so that their edges protrude into the channels and thereby engage the lower edges of the strips 112.

Figure 7:
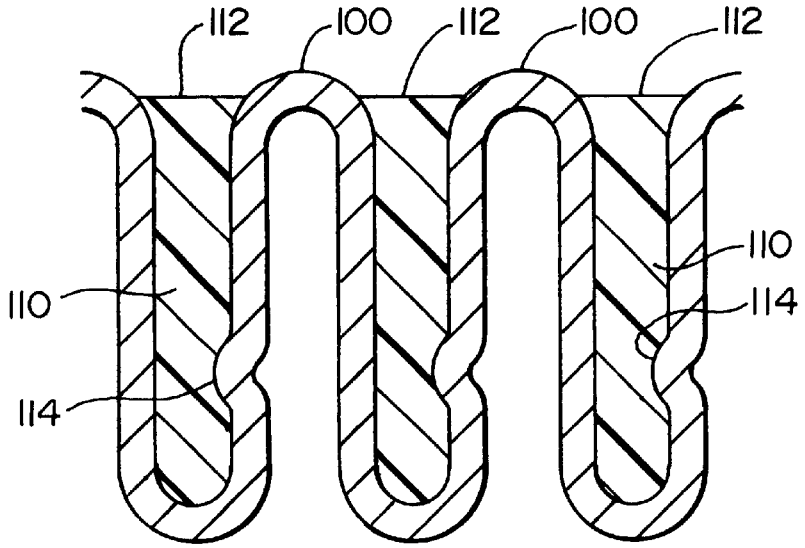
FIG. 7 is an enlarged, cross-sectional view of a portion of the upper web of a spacer bar in accordance with an embodiment of the present invention in which the sides of the corrugations are provided with inwardly-projecting points, rather than the slits which are shown in FIGS. 2–6, showing the manner in which these engage and retain the strips of insulating material.

FIG. 7 shows another form of geometry for retaining the insulating material within the channels, in which pointed projections 114, rather than tabs or slits, extend inwardly from the walls of the channels to engage the insulating material 110. It will be understood that the particular retaining geometry may vary from the examples which are shown in the figures, and may take the form of ridges, indentations, projections, constrictions, scorings or any other configuration which is suitable for engaging and holding the insulating material. Moreover, the retaining geometry may vary in configuration with the type of insulating material being used, and in some embodiments may be absent altogether.

The insulating material 110 itself may be of any suitable type, with a plastic material having good insulating qualities being eminently suitable for this purpose. Resilient, foamed plastic materials are particularly suitable for use as the insulating material, in that the cellular structure allows for a comparatively large degree of compression/expansion in order to accommodate the different expansion rates. Suitable examples of insulating materials include polyurethane foam, which is generally UV resistant, highly stable, and acid resistant. Polyethylene foam may also be used, which has the advantage of relative economy, although this should generally be provided with a "skin" on the exposed side to minimize deterioration. Moreover, the insulating material may contain a fiber material for enhanced stability and durability. Other suitable insulating materials will occur to those skilled in the art, and are also within the scope of the invention.

In some embodiments the insulating material may be formed as a continuous "cap" which fills and spans two or more channels, although in such instances the different expansion rates of the materials may become an even more significant factor, tending to cause the insulation to separate from the web. Also, in those embodiments where it is desired to maintain fluid communication between the interpane airspace and the interior of the spacer via slits in the channels, the insulating material may be formed of an open-cell foam material which is capable of "breathing"; in other embodiments, where the slits are absent or are blocked by the insulating material, the air flow can be maintained through the relatively porous upper seam 50.

d. Two-Piece Construction

Figure 8:
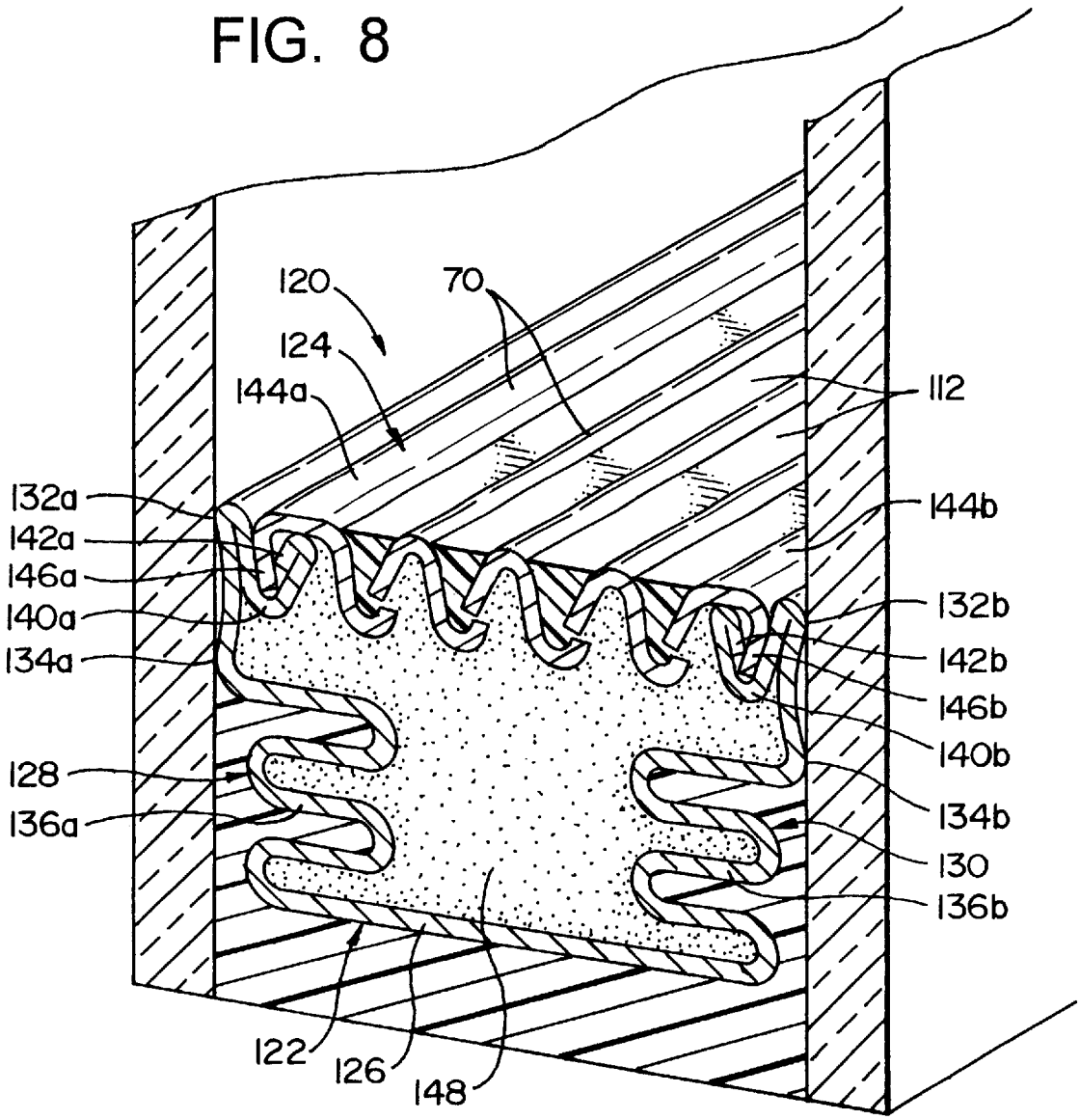
FIG. 8 is a cross-sectional, perspective view similar to FIGS. 2 and 5, showing an embodiment of a spacer frame bar in accordance with another embodiment of the present invention, this having a two-piece construction in which the upper, corrugated web is clipped or otherwise attached along its edges to a lower, "U" shaped channel member.

FIG. 8 shows a tubular spacer bar 120 in accordance with the present invention, having a construction which differs from that described above in that this is a two-piece structure with a somewhat "U" shaped lower channel member 122 and a "clip-on" upper web member 124.

As can be seen, the overall configuration of the lower channel member 122 is somewhat similar to the lower part of the spacer which was described above with reference to FIG. 2, in that this has a bottom web 126 and first and second side webs 128, 130. The side webs also preferably include upper and lower contact lines 132*a*, 132*b* and 134*a*, 134*b*, as well as horizontally extending folds 136*a*, 136*b* for increasing of the length of the conductive path across the bottom of the spacer.

In the embodiment which is shown in FIG. 8, however, flanges are formed inboard of the upper contact lines 132*a*, 132*b*, and these extend downwardly and inwardly and then back upwardly and inwardly to define first and second receiving channels 140*a* and 140*b*. Furthermore, the terminal edges of the flanges are provided with reverse bends so as to form a small locking lips 142*a*, 142*b* along the inward edges of the receiving channels.

The outer edges 144*a*, 144*b* of the upper web member 124, in turn, are bent downwardly and inwardly so as to form first and second downwardly projecting flanges 146*a*, 146*b*. As can be seen in FIG. 8, the edge flanges 146*a*, 146*b* are configured to extend roughly parallel to the sheet metal which forms the outer walls of the receiving channels 140*a*, 140*b*, and extend downwardly from the top web by a distance which is roughly equal to the depth of the receiving channels.

To assemble the spacer 120, the interior of the "U" shaped lower channel member 122 is filled with the desired amount of desiccant material 148, and the upper web member 124 is placed across the top opening of the channel member with the downwardly projecting edge flanges 146*a*, 146*b* positioned in vertical register with the receiving channels 140*a*, 140*b*. The web member is then pressed downwardly against the channel member so that the edge flanges are forced into the receiving channels. As this is done, the lower, somewhat inwardly-angled edges of flanges 146*a*, 146*b* ride over the lips 142*a*, 142*b* of the receiving channels, so that the sides of the channels are spread apart resiliently to accept entry of the flanges.

After the lower edges of the flanges 146*a*, 146*b* have been forced downwardly past the edges of lips 142*a*, 142*b*, the flanges and the sides of the receiving channels spring back to their original configurations, so that the locking lips move inwardly to a position above the lower edges of the flanges (i.e., to the position shown in FIG. 8), thereby capturing the flanges and retaining them against being withdrawn from the receiving channels 140*a*, 140*b*. Thus, once installed, the web member 124 is more or less permanently mounted to the "U" shaped channel member 122.

Figure 10:
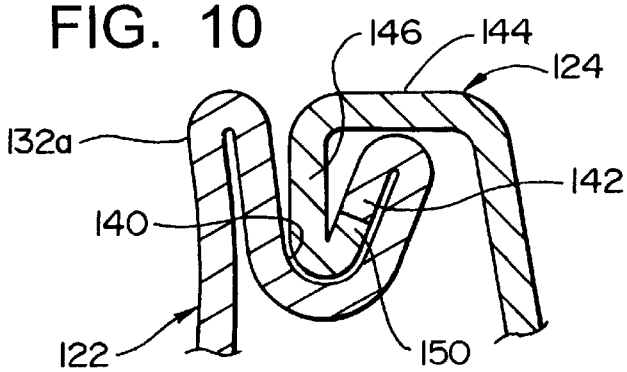
FIG. 10 is an enlarged, cross-sectional view of the joint formed between the upper web and lower channel in another embodiment of the two-piece spacer construction, in which the edge of the upper web has a small return bend for forming a locking interfit with a corresponding lip along the edge of the channel member.

As is shown in FIG. 10, in some embodiments the lower edges of flanges 146*a*, 146*b* may also be provided with reverse bends, which form inwardly and upwardly projecting secondary locking lips 150. Thus, as the edge flanges are pressed home in the receiving channels, the primary locking lips 142 spring or "snap" back so as to move into abutting opposition with the secondary locking lips 150, providing very strong resistance against separation of the web and channel members once mated.

Figure 9:
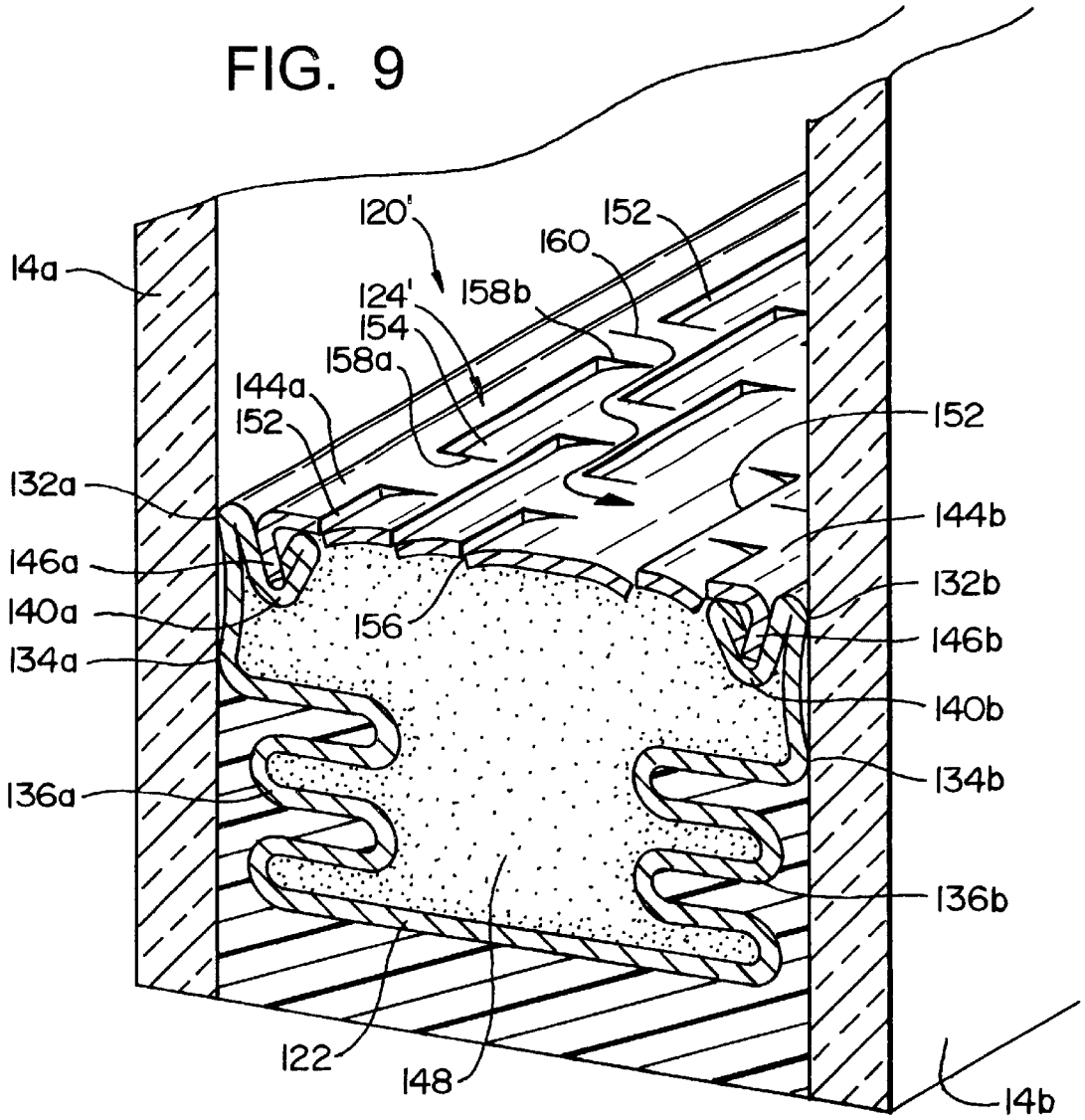
FIG. 9 is a cross-sectional, perspective view similar to FIG. 8, showing another embodiment of spacer bar having a two-piece construction, this having a generally flat, slitted top web in place of the corrugated web which is shown in FIG. 8.

A particular advantage of the two-piece "snap together" construction which is shown in FIGS. 8–10 is that the "broken" attachment points along the two edges of the spacer create discontinuities which further reduce conductive heat transfer across the upper web of the spacer. Furthermore, the "breaks" at the edge joints permit air/gasses to pass between the interpane space and the interior of the spacer, even in embodiments in which the upper web itself lacks any slits or other perforations.

Still further, this arrangement permits the upper web to be formed of a separate material, such as stainless steel, which exhibits a lower rate of thermal heat transmission than most metals but which is also more costly, while allowing the remainder of the assembly (i.e., the "U" shaped lower channel member) to be formed of a less expensive material such as ordinary steel or aluminum. Similarly, the separate upper web member can be painted, coated or otherwise treated for reduced thermal gain or other enhanced characteristics, without having to treat the entire assembly.

Moreover, the snap-together construction allows upper web members of different types to be interchangeably mounted on a common form of lower channel, thereby allowing for simplified and more economical manufacture of different models of spacer bar. For example, as can be seen in FIG. 8, the upper web member 124 may be formed with a series of parallel corrugations 70, with or without embedded insulating strips 90, similar to the embodiments which have been described above. Alternatively, other forms of upper web members can be mounted to an identical channel member in the same manner. For example, FIG. 9 shows a spacer 120' which the upper web member 124', rather than being corrugated, is a generally planar member having several rows of staggered slits 152. Although lacking the corrugations, the slits 152 are formed in essentially the same manner as described above (except that the tab portions 154 are bent downwardly rather than upwardly), so that the longitudinal edges of each slit are separated by a narrow air gap 156. Also, as was described above, first and second breaks/tears 158*a*, 158*b* extend laterally from the ends of each slit towards the next row of slits, so that thermal energy must follow an elongate, circuitous path in order to travel from one glass pane to the other, as indicated by arrow 160.

It is to be recognized that various alterations, modifications, and\or additions may be introduced into the constructions and arrangements of parts described above without departing from the spirit or ambient of the present invention.

What is claimed is:

1. A spacer frame bar comprising:

an elongate tubular spacer member having first and second side webs for engaging first and second glass panes of a window assembly in spaced relationship, and an upper web for facing inwardly towards an interpane space between said panes and a lower web for facing outwardly from a perimeter of said window assembly;

said lower web of said spacer member being substantially free of openings; and said upper web of said spacer member having a plurality of openings for passage of air therethrough and comprising:

at least first and second corrugations formed in said upper web, each said corrugation defining an upwardly extending ridge portion and a downwardly extending channel portion, so that said corrugations form an elongate thermal energy conductive path across said upper web which is greater in length than said spacer width between said side webs;

said corrugations further being oriented so that only an upper edge of each said ridge portion is exposed to solar radiation in said interpane space between said glass panes and said channel portions of said corrugations are substantially shaded from solar radiation by adjacent corrugations, so that said upper web of said spacer member forms said elongate conductive path without causing increased thermal gain of said spacer member when said window assembly is exposed to said solar radiation.

2. The spacer frame bar of claim 1, wherein said at least first and second corrugations comprise:

a plurality of generally parallel, longitudinally extending corrugations arranged across a width of said upper web of said spacer member.

3. The spacer frame bar of claim 2, wherein said ridge portions and said channel portions of said corrugations are oriented in a substantially vertical direction.

4. The spacer frame bar of claim 2, wherein said upper edges of said ridge portions each comprise:

a curved outer surface for scattering solar radiation which strikes said upper edge of said ridge portion.

5. The spacer frame bar of claim 2, wherein said upper web of said spacer member further comprises:

at least one spaced sequence of longitudinally oriented slits formed through said upper web in each of said corrugations, so that said slits form a series of thermal breaks across said upper web of said spacer member.

6. The spacer frame bar of claim 5, wherein said spaced sequence of slits in each corrugation is staggered longitudinally relative to said spaced sequences of slits in adjacent corrugations.

7. The spacer frame bar of claim 6, wherein said spaced sequences of slits are formed in side walls of said corrugations intermediate said upper edges of said ridge portions and lower ends of said channel portions.

8. The spacer frame bar of claim 7, wherein each said corrugation comprises:

at least two said spaced sequences of slits formed on opposite sides of said corrugation.

9. The spacer frame bar of claim 5, wherein each slit in said spaced sequences of slits comprise:

a first longitudinal edge portion which is displaced relative to a second longitudinal edge portion by an amount which is sufficient to open an air gap between said edge portions of said slit, so that said slits form said plurality of openings in said upper web of said spacer member.

10. The spacer frame bar of claim 9, wherein said upper web of spacer member is formed of malleable metal sheet material.

11. The spacer frame bar of claim 10, wherein said first edge portion of each slit is displaced relative to said second edge portion of said slit by an amount which is sufficient to form first and second transverse breaks in said metal material which extend generally laterally from first and second ends of said slits so as to interrupt conduction of thermal energy across said breaks.

12. The spacer frame bar of claim 11, wherein said transverse breaks at said ends of said slits extend laterally from a first sequence of slits towards a second sequence of slits.

13. The spacer frame bar of claim 2, wherein each said upper web of said spacer member further comprises:

at least one insulating member mounted in said corrugations in said upper web of said spacer member.

14. The spacer frame bar of claim 13, wherein said at least one insulating member comprises:

a plurality of insulating strips formed of insulating material, each said insulating strip being mounted in said channel portion of one of said corrugations in said upper web member.

15. The spacer frame bar of claim 14, wherein said insulating strips substantially fill said channel portions of said corrugations, so that only an upper crown of each said ridge portion is exposed above said insulating material.

16. The spacer frame bar of claim 14, wherein said insulating material comprises a resilient foam material.

17. The spacer frame bar of claim 14, wherein each said channel portion of said corrugations comprises:

means for engaging and retaining said strip of insulating material in said channel portion.

18. The spacer frame bar of claim 17, wherein said means for retaining said strip comprises at least one inwardly-bent tab portion of a slit formed in a wall of said channel portion.

19. The spacer frame bar of claim 17, wherein said means for retaining said strip comprises at least one inwardly-protruding point formed in a wall of said channel portion.

20. The spacer frame bar of claim 1, wherein said spacer member is formed of inner and outer halves, said halves being joined along upper and lower longitudinally extending seams.

21. The spacer frame bar of claim 20, wherein said upper and lower longitudinally extending seams each comprise interleaved rows of tabs formed along edges of said inner and outer halves of said spacer member.

22. The spacer frame bar of claim 21, wherein said interleaved rows of tabs of said lower longitudinally extending seam are bent upwardly in a generally inverted "V" configuration so as to increase a length of a thermal conductive path across said lower web of said spacer member.

23. The spacer frame bar of claim 1, wherein said spacer member is formed of a lower channel member which incorporates said lower and side webs of said spacer member, and an upper cap member which incorporates said upper web of said spacer member, first and second outer edges of said cap member cooperating with first and second upper edges of said channel member to form connection joints by which said cap member is mounted to said channel member.

24. The spacer frame bar of claim 23, wherein said connection joints each comprise:

a generally "V" shaped receiving channel formed along said upper edge of said channel member; and a flange portion formed along said outer edge of said cap member and extending downwardly therefrom into engagement with said receiving channel.

25. The spacer frame bar of claim 24, wherein each said receiving channel comprises:

a lip portion which extends downwardly from an edge of said receiving channel to a position above a lower edge of said flange portion, so as to retain said flange portion against being withdrawn upwardly out of said receiving channel.

26. The spacer frame bar of claim 25, wherein each said flange portion comprises:

a lip portion which extends upwardly from said lower edge of said flange portion so as to engage said lip portion of said receiving channel in substantially vertical abutment therewith.

27. A two-piece spacer frame bar comprising:

an elongate, generally "U" shaped lower channel member having a lower web and first and second side webs for engaging first and second glass panes of a window assembly in spaced relationship;

an elongate upper cap member having an upper web for spanning from said first side web to said second side web; and means for attaching first and second outer edges of said cap member to first and second upper edges of said channel member so as to form an elongate, tubular spacer member which defines a substantially enclosed interior space, said means for attaching said outer edges of said cap member to said upper edges of said channel member comprising:

a generally "V" shaped receiving channel formed along each said upper edge of said channel member; and a downwardly extending flange portion formed along each said outer edge of said upper cap member for being inserted in interlocking engagement with a corresponding one of said receiving channels.

28. The spacer frame bar of claim 27, wherein each said generally "V" shaped receiving channel comprises:

an upper edge portion of a side web of said channel member which extends inwardly and downwardly and then inwardly and upwardly so as to follow a generally "V" shaped contour.

29. The spacer frame bar of claim 28, wherein each said flange portion on said cap member comprises:

a lower edge portion which extends inwardly and downwardly generally parallel to said inwardly and downwardly extending upper edge of said side web.

30. The spacer frame bar of claim 29, wherein each said generally "V" shaped receiving channel further comprises:

a lip portion which extends outwardly and downwardly from an inner edge of said receiving channel to a position above said lower edge portion of said flange portion, so as to retain said flange portion against being withdrawn upwardly out of said receiving channel.

31. The spacer frame bar of claim 30, wherein each said flange portion comprises:

a lip portion which extends inwardly and upwardly from a lower edge of said flange portion so as to engage said lip portion of said receiving channel in substantially vertical abutment therewith.

32. A method for constructing a window assembly, said method comprising the steps of:

providing an elongate tubular spacer member having first and second side webs and upper and lower webs spanning from said first side web to said second side web and defining a spacer width between said side web, said upper web of said spacer member comprising:

at least first and second corrugations formed in said upper web, each said corrugation defining an upwardly extending ridge portion and a downwardly extending channel portion, so that said corrugations form an elongate thermal energy conductive path across said upper web which is greater in length than said spacer width between said side webs; and mounting said elongate tubular spacer member between first and second glass panes in said window assembly so that said panes are supported in a spaced relationship and so that said upper web faces inwardly towards an interpane spacer between said panes and said lower web faces outwardly from a perimeter of said window assembly;

so that said corrugations are oriented so that only an upper edge of each said ridge portion is exposed to solar radiation in said interpane space between said glass panes and said channel portions of said corrugations are substantially shaded from solar radiation by adjacent corrugations, whereby said upper web of said spacer member forms said elongate conductive path without causing increased thermal gain of said spacer member when said window assembly is exposed to said solar radiation.

* * * * *